US006385873B1

(12) United States Patent
Probst

(10) Patent No.: US 6,385,873 B1
(45) Date of Patent: May 14, 2002

(54) STEAM IRON WITH THICKENED SOLE PLATE REGION

(75) Inventor: Emanuel Probst, Zürich (CH)

(73) Assignee: Jura Elektroapparate AG, Niederbuchsiten (CH)

( * ) Notice: Subject to any disclaimer, the term of this patent is extended or adjusted under 35 U.S.C. 154(b) by 0 days.

(21) Appl. No.: 09/786,031

(22) PCT Filed: Aug. 28, 1999

(86) PCT No.: PCT/EP99/06362

§ 371 Date: Apr. 25, 2001

§ 102(e) Date: Apr. 25, 2001

(87) PCT Pub. No.: WO00/12807

PCT Pub. Date: Mar. 9, 2000

(30) Foreign Application Priority Data

Sep. 1, 1998 (DE) ..... 298 15 676 U

(51) Int. Cl.[7] ..... D06F 75/38
(52) U.S. Cl. ..... 38/93
(58) Field of Search ..... 38/88, 93, 77.83; 219/245, 254

(56) References Cited

U.S. PATENT DOCUMENTS

| | | | | |
|---|---|---|---|---|
| 2,222,327 A | * | 11/1940 | Walkup | 38/93 |
| 2,384,644 A | | 9/1945 | Schreyer | |
| 2,561,189 A | | 7/1951 | Finlayson | |
| 2,957,257 A | | 10/1960 | Abbott | |
| 4,233,763 A | | 11/1980 | McMullen | |
| 5,028,295 A | | 7/1991 | Cracchiolo | |
| 5,613,309 A | * | 3/1997 | Amsel et al. | 38/93 |
| 6,122,849 A | * | 9/2000 | Kida et al. | 38/93 |

FOREIGN PATENT DOCUMENTS

| | | |
|---|---|---|
| CH | 343355 | 2/1960 |
| DE | 328230 | 10/1920 |
| DE | 87 17 313 | 9/1988 |
| DE | 41 07 236 | 9/1992 |
| DE | 693 02 418 | 9/1996 |
| FR | 1306536 | 9/1962 |
| GB | 733981 | 7/1955 |

* cited by examiner

*Primary Examiner*—Ismael Izaguirre
(74) *Attorney, Agent, or Firm*—Venable; Gabor J. Kelemen

(57) ABSTRACT

The invention relates to an electrically-heated steam iron, in which an electric heating body is connected to an iron soleplate (2) in a thermally-conductive manner. The iron soleplate (2) is provided on its running surface with a coating or an additional soleplate having a relatively poor thermal conductivity. In accordance with the invention, the iron soleplate (2) has a thickened region (14) at its tip, the region (14) comprising a material that conducts and retains heat well, and being disposed in the soleplate tip region, so no disruptive drop in temperature occurs here. The thickened region (14) is embodied with two legs, which extend around a steam labyrinth (7) on the surface of the iron soleplate.

9 Claims, 3 Drawing Sheets

STEAM IRON WITH THICKENED SOLE PLATE REGION

BACKGROUND OF THE INVENTION

The invention relates to an electrically-heated iron, specifically a steam iron.

In known irons of this type, an iron soleplate comprising aluminum receives an electrical heating body, which is referred to as a heating insert, and is connected to the soleplate in a thermally-conductive manner. In an embodiment of the iron as a steam iron, a steam chamber, steam-forcing conduits and a steam labyrinth are further formed out of the surface of the iron soleplate, the labyrinth opening to a running surface of the iron soleplate by way of steam holes. The iron soleplate is made of aluminum to assure a good heat transfer. To improve the sliding capability or increase the scratch resistance, or for aesthetic reasons, the iron soleplate is encased by a thin steel film or provided on its underside with an additional soleplate, which comprises steel and can be a few millimeters thick. A fundamental drawback of this coating or jacket, or the additional, steel soleplate, however, is that it has a lower thermal conductivity than the aluminum soleplate. This relatively poor thermal conductivity causes a delay in the heat transfer between the heating element of the iron and an item to be ironed. This is primarily evident in the tip of the soleplate, where the temperature of the soleplate can drop dramatically, when edges, seams or creases are ironed.

Already known from the state of the technology is an electric iron comprising an iron soleplate with an electric heating body and a curved handle part disposed at a distance above the iron soleplate. A two-legged spacer is disposed between the top of the curved handle part and the iron soleplate, in the region of the iron tip (DE-G 97 17 313.1). A retaining latch, which extends around a curved peak of a curved handle part in the assembled state, can be formed onto the forward, upper region of the spacer. The spacer is intended to permit a connection of the thermoplastic top handle parts with the metal iron soleplates without an air gap in the region of the iron tip, which normally shields the top part against the heat emanating from the iron soleplate. This avoids a disadvantage of the air gap in that ribbons, bows, buttons, closures or similar accessories of items to be ironed can be caught between the top part and the iron soleplate. For the spacer to maintain the heat-shielding function of the air gap relative to the top, the spacer must comprise a material having a poor thermal conductivity. The electrically-heated iron having spacers is therefore affected by the same drawback mentioned above in connection with the known steam irons having no such spacers, specifically the undesired dramatic cooling of the iron tip.

A known electrically-heated steam iron has an iron soleplate connected to an electrically-heated substance in a thermally-conductive manner, and includes a plastic possessing a relatively poor thermal conductivity. The iron further includes a raised edge having a peripheral groove that extends around all but the rear side of the iron soleplate. The groove serves to receive the heated substance (U.S. Pat. No. 4,233,763). In the region of the soleplate tip, the edge changes over to a protrusion with a threaded hole for receiving a fastening screw. Steam conduits in the heated mass end, as seen in the longitudinal direction of the iron, at a distance from the protrusion. The small protrusion and the grooved edge, like the rest of the iron soleplate, comprise a plastic possessing a poor thermal conductivity and are neither suitable, nor provided, for significantly influencing the thermal conditions in the region of the soleplate tip.

It is therefore the object of the present invention to provide an electrically-heated steam iron of the generic type described at the outset with an uncomplicated embodiment such that no disruptive temperature drop occurs in the region of the soleplate tip, on the running surface of an additional, steel soleplate when heat is drawn from the soleplate tip during ironing. This should produce better, faster and more uniform ironing results in the use of the iron. The invention is intended to retain the advantages of a running surface that is coated or provided with a covering or an additional soleplate.

This object is accomplished by the embodiment of the electrically-heated steam iron having an iron soleplate, an electrical heating body, and a running surface with either a coating or an additional soleplate having relatively poor thermal conductivity. The tip region of the iron soleplate has a thickened region comprising a material that conducts and retains heat well. This material can be aluminum, which also can be used for the iron soleplate. The provision of a steel coating for this iron soleplate, steel being a material that has a poor thermal conductivity relative to aluminum, does not cause an undesired dramatic temperature drop in the region of the soleplate tip during ironing, because the heat transfer between the heating element of the iron and the ironed item, which is delayed due to the low thermal conductivity of steel, is compensated by the thickened soleplate tip that conducts and retains heat well. The thickened soleplate tip region, having a material that conducts and retains heat well, assures a rapid dispensation of heat to the soleplate tip, which, on average, attains an even higher temperature in the soleplate tip region over time that is attained in the rest of the soleplate. This is critical in a steam iron because of the heat escaping through evaporating water. For this purpose, the thickened region is embodied with two legs, which appear nearly V-shaped in a plan view. The legs extend, at least partially, around a steam generator and, particularly, a steam labyrinth on the surface of the iron soleplate, which draws a relatively large amount of heat from the soleplate and thus assists in colin a partial region of the soleplate.

Other variations and advantageous embodiments of the invention are disclosed herein.

With a nose-like embodiment of the thickened region, the desired temperature course is attained in the soleplate tip, and uniformly changes over the remaining soleplate surfaces or the running surface. This shape also does not impede ironing with the soleplate tip.

One variation the thickened region can be formed out of the iron soleplate in one piece. In this instance, the thickened region comprises the same material as the soleplate, particularly aluminum. This precludes difficulties in the transfer of heat between the soleplate and the thickened region.

The thickened region can be embodied as a separate body that is secured, for example, screwed, to the soleplate so as to conduct heat well. The advantage of this variation is that the body can be produced separately to fit conventional iron soleplates. In other words, it is not absolutely necessary to set up a special soleplate production.

Optionally, the soleplate has no depression in the area between the thickened region and the heating body that would essentially obstruct the transfer of heat. The steam labyrinth can be disposed essentially above the thickened region. These features ensure that the heat generated by the heating body is conducted properly into the thickened region.

Further features and advantages of the invention ensue from the following description.

BRIEF DESCRIPTION OF THE DRAWINGS

An embodiment of the invention is described below in conjunction with three drawing figures. Shown are in.

Figure 2:
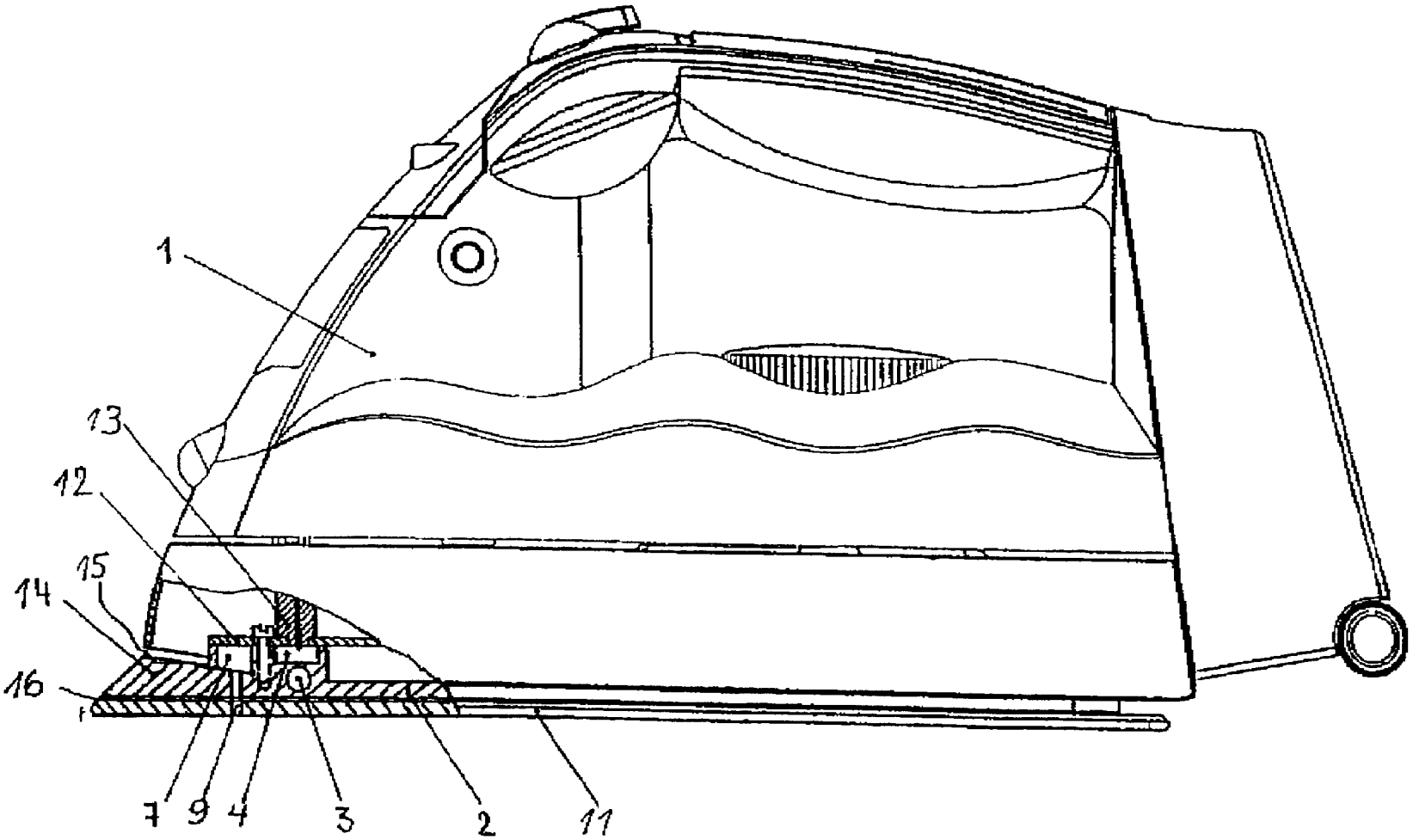
FIG. 2 a side view of the steam iron in accordance with FIG. 1, with a cutaway view of the iron tip region.

In the drawing, 1 represents a steam-iron body, which has a lower housing and a water tank above it, and a handle. Disposed beneath the housing of the steam-iron body is an iron soleplate 2 comprising aluminum. An air gap shown in the region of the soleplate tip is formed between the plastic housing of the steam-iron body and the soleplate 2. A heating body 3, which can be seen in cross-section in FIG. 2, is recessed into the soleplate. Disposed above the heating body 3 is a steam chamber 4, with steam-forcing conduits 5 and 6 bordering both side of it as legs. Extending toward the front, i.e. toward the iron tip, essentially parallel to the conduits, is a steam labyrinth 7, which has steam holes 8, 9, 10 in its floor that extend through the soleplate and through an additional soleplate, which comprises steel 11 and is mounted to the underside of the soleplate.

It can be seen from FIG. 2 that the steam chamber 4 and the steam labyrinth 7 are covered at the top by a steam-conduit lid 12, which also extends above the steam-forcing conduits 5 and 6. A water valve 13 extends from the water tank, not shown, through the steam-conduit lid 12 and into the steam chamber 4.

Figure 1:
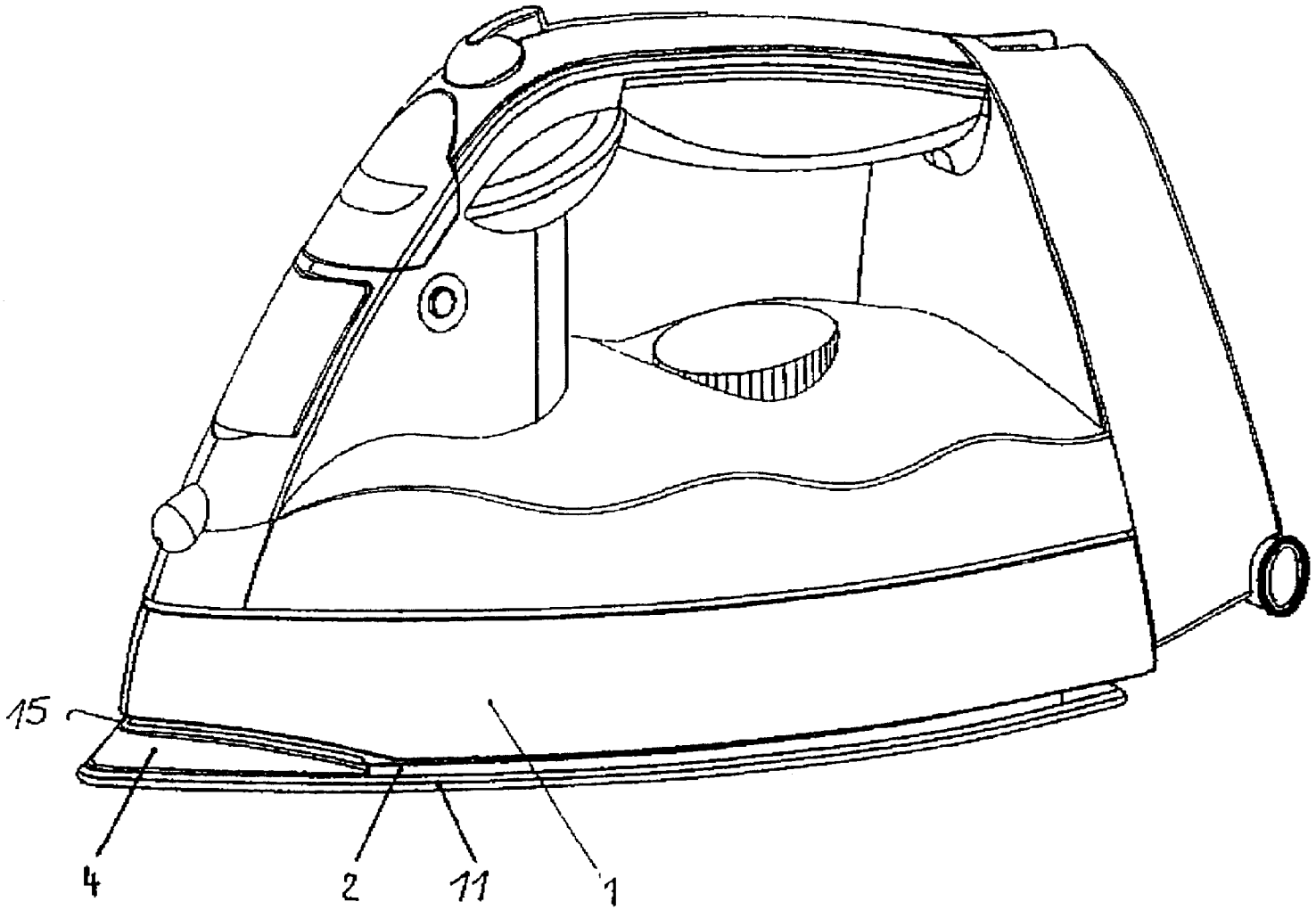
FIG. 1 an electric steam iron in a lateral, perspective view.
Figure 3:
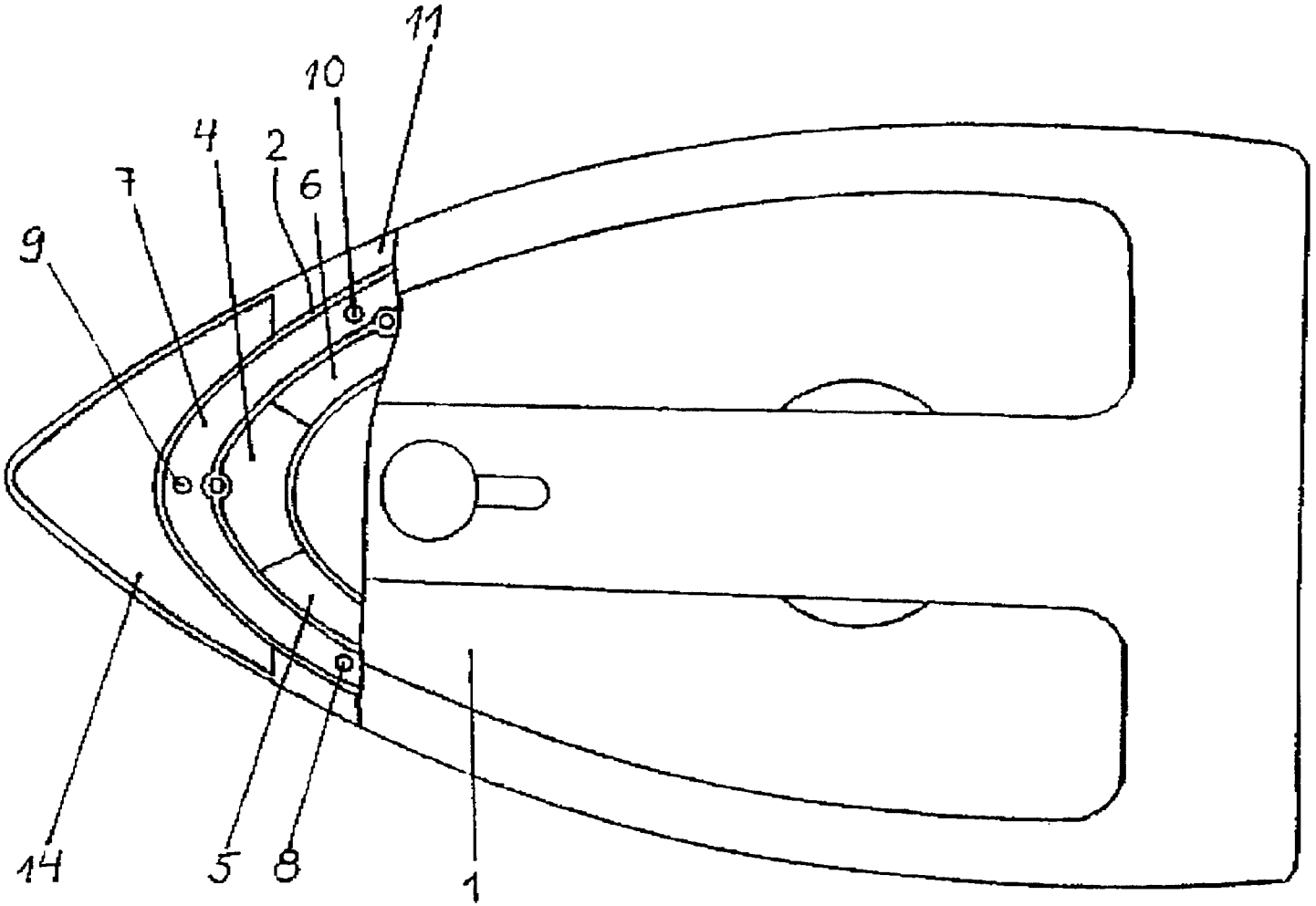
FIG. 3 a plan view of the steam iron according to FIGS. 1 and 2, also with a cutaway view of the iron tip region.

In the region of the soleplate tip, the soleplate 2 has a nose- or plough-shaped thickened region 14, which extends partly around the steam labyrinth 7 and the steam chamber 4 with two legs, not shown, in the plan view of FIG. 3. The thickened region comprises the same thermally-conductive material as the soleplate, namely aluminum, which also has a relatively high thermal capacity. The shape and the location of the thickened region at the soleplate tip not only effect a higher average temperature over time than in the absence of such a thickened region, but they also assure the desired temperature of the bordering steam-generating or steam-conducting elements. For attaining the desired temperature course of the soleplate tip, which otherwise should have a shape that is suitable for ironing, the thickness of the thickened region initially increases dramatically from the soleplate tip and an outer edge 16, then gradually decreases toward the soleplate 2, as can be seen in detail in FIGS. 1 and 2. For shielding the housing of the iron body 1 from the increased temperature at the thickened region 14 of the soleplate tip, the air gap 15 is disposed between the top of the thickened region and the housing, the gap thus being located higher and further back than the conventional air gap between the top of an iron soleplate and a plastic housing.

LIST OF REFERENCE CHARACTERS

1 Iron body
2 Iron soleplate (with heating body)
3 Heating body
4 Steam chamber
5 and 6 Steam-forcing conduit
7 Steam labyrinth
8, 9 10 Steam hole
11 Additional (steel) soleplate
12 Steam-conduit lid
13 Water valve
14 Thickened region at soleplate tip
15 Air gap
16 Outer edge of soleplate

What is claimed is:

1. An electrically-heated iron, comprising:

a heat conductive soleplate having a running surface carrying one of a coating and an additional soleplate; said coating and said additional soleplate having a poorer thermal conductivity than said soleplate, said soleplate converging into a tip;

a steam labyrinth arranged on the soleplate, an electric heating body connected in a thermally-conductive manner to the soleplate; and a thickened element adjacent to the tip being formed of a heat conducting and heat retaining material, said thickened element having two legs straddling the steam labyrinth.

2. The electrically-heated iron according to claim 1 wherein the thickened element is nose-shaped and adjoins an outer edge of the soleplate, the thickened region having a first portion at the tip, a second portion rear of the first portion, and a third portion rear of the second portion, wherein the second portion has a greater thickness than the first and third portions.

3. The electrically-heated iron according to claim 1, wherein the thickened element is integral with the soleplate.

4. The electrically-heated iron according to claim 1, wherein the thickened element is a body secured to the soleplate in a thermally-conductive manner.

5. The electrically-heated iron according to claim 1, wherein one of said coating and said additional soleplate includes steel.

6. The electrically-heated iron of claim 1, wherein the soleplate includes aluminum.

7. The electrically-heated iron of claim 1, wherein the thickened element includes aluminum.

8. The iron according to claim 1, wherein the steam labyrinth is disposed essentially above the thickened element.

9. The electrically-heated iron according to claim 1, wherein the soleplate is void of any heat transfer obstructing depression in an area between the thickened element and the heating body.

* * * * *